US007728247B2

(12) United States Patent
Pikkala et al.

(10) Patent No.: US 7,728,247 B2
(45) Date of Patent: Jun. 1, 2010

(54) SWITCHING DEVICE

(75) Inventors: Osmo Pikkala, Sundom (FI); Harri Mattlar, Iskmo (FI)

(73) Assignee: ABB OY, Helsinki (FI)

( * ) Notice: Subject to any disclaimer, the term of this patent is extended or adjusted under 35 U.S.C. 154(b) by 0 days.

(21) Appl. No.: 10/585,354

(22) PCT Filed: Jan. 18, 2005

(86) PCT No.: PCT/FI2005/000028

§ 371 (c)(1),
(2), (4) Date: Jul. 6, 2006

(87) PCT Pub. No.: WO2005/069328

PCT Pub. Date: Jul. 28, 2005

(65) Prior Publication Data

US 2007/0145016 A1 Jun. 28, 2007

(30) Foreign Application Priority Data

Jan. 19, 2004 (FI) ..... 20040068

(51) Int. Cl.
*H01H 3/00* (2006.01)

(52) U.S. Cl. ..... 218/155; 200/244; 218/35

(58) Field of Classification Search ..... 218/7, 218/14, 15, 31, 34, 35, 153–157; 200/243–250; 335/16, 147, 195

See application file for complete search history.

(56) References Cited

U.S. PATENT DOCUMENTS

| | | | | |
|---|---|---|---|---|
| 4,401,863 | A * | 8/1983 | Lemmer et al. | 200/16 A |
| 4,596,911 | A | 6/1986 | Guery et al. | |
| 4,910,485 | A * | 3/1990 | Bolongeat-Mobleu et al. | 335/195 |
| 5,281,776 | A | 1/1994 | Morel et al. | |
| 5,357,066 | A * | 10/1994 | Morel et al. | 200/17 R |
| 5,448,033 | A * | 9/1995 | Leone et al. | 218/146 |
| 5,969,314 | A * | 10/1999 | Rakus et al. | 218/7 |

OTHER PUBLICATIONS

Written Opinion of the International Searching Authority dated May 11, 2005.

Finland Search Report dated Nov. 30, 2004 (with English translation of category of cited documents).

* cited by examiner

*Primary Examiner*—Renee S Luebke
*Assistant Examiner*—Marina Fishman
(74) *Attorney, Agent, or Firm*—Buchanan Ingersoll & Rooney PC

(57) ABSTRACT

A switching device is disclosed which includes a frame, a first connector and a second connector, the first connector and the second connector extending from inside the frame outside the frame. The first and the second connector are electrically connected to one another, and one or more gas flow openings are provided in the frame and arranged for a gas flow produced by a switching event. In its portion remaining inside the frame, the first connector includes a hole provided for said gas flow.

12 Claims, 1 Drawing Sheet

SWITCHING DEVICE

BACKGROUND OF THE INVENTION

Figure 1:
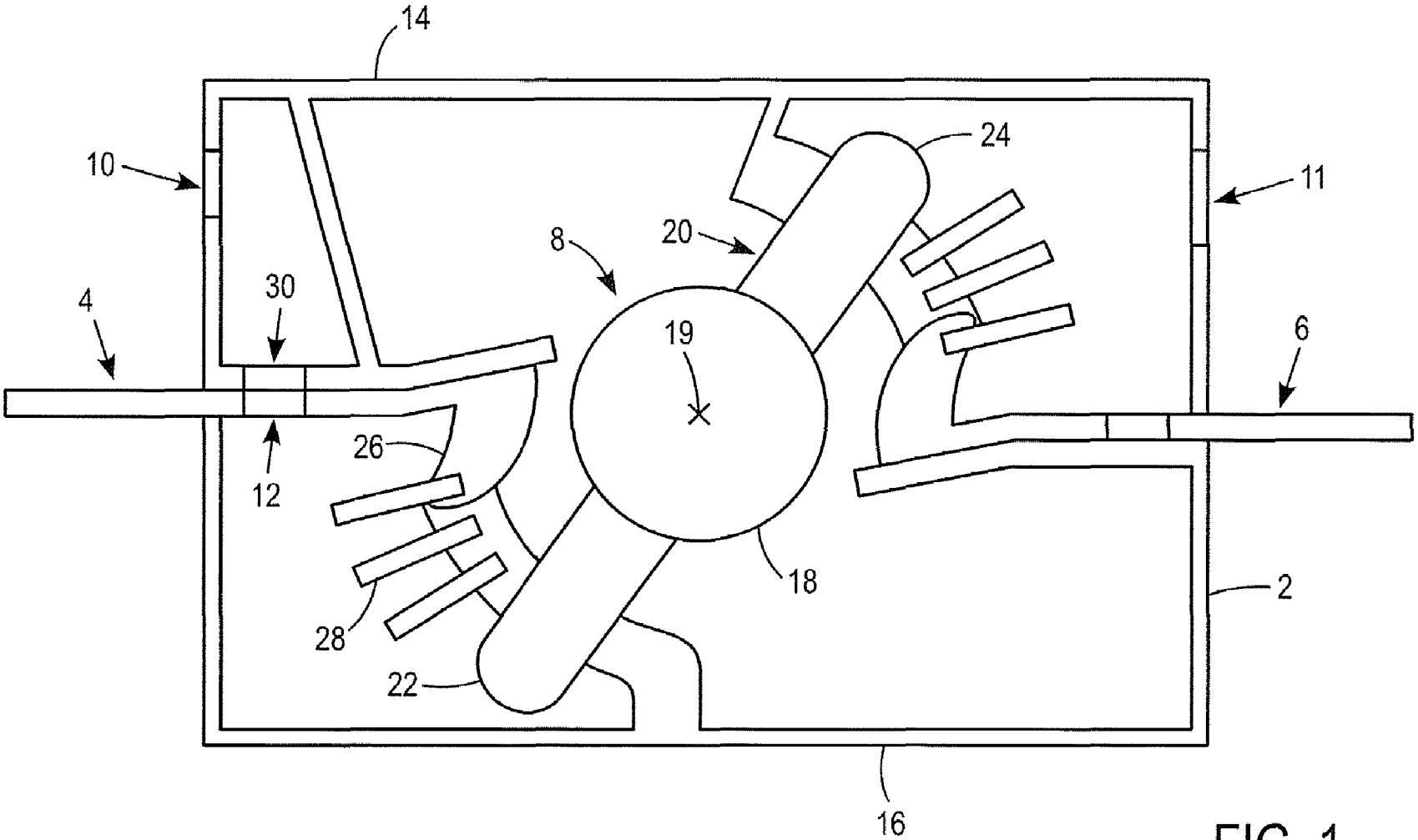

The invention relates to a switching device according to the preamble of the independent claim.

Switching devices are equipment used for opening and closing a current circuit. A switching device comprises at least one pole and a control device arranged to open and close this pole. Switching devices include e.g. switches and switch-fuses.

When a current circuit is opened, an electric arc whose temperature is thousands of degrees may occur in a switching device. An electric arc includes ionized gas which contains a large number of free electrons. Such a gas plasma is electrically conductive.

In addition to the electric arc being conductive, metal which has been vaporized from contacts by the electric arc may, upon solidification, impair the insulation capacity of the surfaces of the switching device. Soot produced by the electric arc may also cause insulation problems.

Switching devices wherein air is used as an insulating material comprise a discharge route for heated air. The discharge route enables expanded gas to discharge from the frame of the switching device, which prevents pressure inside the switching device from becoming too high.

A problem with the known switching devices is that in connection with a switching event, gas discharging from the frame of the switching device may cause an earth fault between a live part of the switching device and an adjacent earthed part.

BRIEF DESCRIPTION OF THE INVENTION

An object of the invention is to provide a switching device to enable the above-described problem to be alleviated. The object of the invention is achieved by a switching device which is characterized by what is disclosed in the independent claim. Preferred embodiments of the invention are disclosed in the dependent claims.

The idea underlying the invention is that in its part remaining inside the frame, a connector of the switching device is equipped with a hole arranged for a gas flow.

An advantage of the switching device according to the invention is that disadvantages in a switching device caused by discharging gases are minimized.

DETAILED DESCRIPTION OF THE INVENTION

The invention is now described in closer detail in connection with the preferred embodiments and with reference to accompanying FIG. 1, which shows a cross-section of a switching device according to an embodiment of the invention. The switching device of FIG. 1 is in an open position, i.e. in a position wherein a current circuit connected thereto is open.

The switching device of FIG. 1 comprises a frame 2 having an upper part 14 and a lower part 16. The frame 2 is provided with a first connector 4, a second connector 6 and means 8 for electrically connecting the first 4 and the second 6 connector with one another. The first connector 4 and the second connector 6 extend from inside the frame 2 outside the frame. The connectors 4 and 6 are formed from a substantially planar preform by bending. The switching device is connected to the current circuit it is adapted to open and close by the first connector 4 and the second connector 6.

The frame 2 is preferably manufactured from an electrically insulating material, such as plastics.

The frame 2 is provided with two gas flow openings. The gas flow openings 10 and 11 are arranged to allow gas to flow between the inner part and the surrounding environment of the frame. The first gas flow opening 10 resides above the first connector 4 while the second gas flow opening 11 resides above the second connector 6. Each gas flow opening resides on the same side of the frame 2 as the corresponding connector.

In its part remaining inside the frame 2, the first connector 4 is provided with a hole 12 for a gas flow. A part of the frame 2 adjacent to the connector 4 is provided with an opening 30 for a gas flow corresponding with the hole 12.

The second connector 6 is identical with the first connector 4, so the switching device necessitates connectors of only one kind to be manufactured.

The gas flow openings 10 and 11 reside at the upper part 14 of the frame. The switching device is mounted in its mounting space, such as a switchgear cubicle, such that the lower part 16 of the switching device resides closer to frame structures of the mounting space than the upper part 14 of the switching device does. The gas flow openings 10 and 11 thus reside farther from the frame structures of the mounting space than the first connecter 4 and the second connector 6 do.

An inner end of each connector 4 and 6 is provided with a projection 26 which extends at a substantially perpendicular plane with respect to the rest of the corresponding connector. The projection 26 of the first connector 4 extends downwards with respect to the other parts of the connector 4 while the projection 26 of the second connector 6 extends upwards with respect to the other parts of the connector 6.

The means 8 for electrically connecting the first connector 4 and the second connector 6 with one another comprise a roll 18 and a pair of contacts 20 attached thereto. The pair of contacts comprises two juxtaposed contacts 20, of which FIG. 1 shows one. The roll 18 is rotatably mounted with respect to the frame 2.

When the current circuit is closed, a first end 22 of the contacts 20 is in contact with the first connector 4 while a second end 24 of the contacts is in contact with the second connector 6. Each projection 26 thus almost completely resides between, and in contact with, the ends of the contacts 20.

The current circuit is opened by rotating the roll 18 around its rotation axis 19 anticlockwise to a position wherein the contacts 20 are not in contact with the connectors 4 and 6. Upon opening the current circuit, a conductive gas plasma is generated, as mentioned above. A rise in temperature increases the pressure of the air inside the frame 2. The pressure is allowed to discharge through the gas flow openings 10 and 11.

During a switching event, a gas plasma corresponding with the first connector 4 is generated beneath the first connector 4. As stated above, the gas flow channel corresponding with the first connector comprises a hole 12 provided in the first connector 4 to enable hot gases to flow towards the gas flow opening 10. Since the connector 4 is made of metal, it contributes to cooling down the flowing gas. The gas flow is also cooled down when it hits metallic arc extinguisher plates 28.

The hole 12 of the connector 4 may be the only possible route for gases when they flow towards the gas flow opening 10. In a modular switching device, for instance, the width of the connectors 4 and 6 may be almost equal to the inner width of the frame 2 of the module. Consequently, no extra room is left for a gas flow channel. A width direction herein refers to a direction parallel to the rotation axis 19.

The gas flow channels through which hot gases generated by a switching event flow towards the gas flow openings 10 and 11 are designed such that the gases have cooled down sufficiently upon discharge from the frame 2. The cooler the discharging gas, the less electrically conductive it is. The discharging gas being poorly electrically conductive is advantageous as far as the insulation characteristics of the switching device are concerned. Increasing the length of the flow route and adding heat absorbing structures along the flow route for gases lower their temperature.

During a switching event, a gas plasma corresponding with the second connector 6 is generated above the second connector 6. Consequently, the connector 6 does not reside in the flow route of gases. Therefore, the structures of the frame 2 are provided with no opening corresponding with a hole 12 of a connector 6. The gases are thus not allowed to flow through the hole 12 of the second connector 6. The fact that the frame 2 necessitates no opening corresponding with a hole 12 of a connector 6 makes the frame 2 stiffer.

A flow channel corresponding with the first connector 4 through which gases generated in a switching situation progress to the gas flow opening 10 is relatively long and its volume is relatively large. A flow channel corresponding with the second connector 6, in turn, is relatively short and its volume is small as compared with the flow channel corresponding with the first connector 4.

The cross section of the gas flow opening 10 in the vicinity of the first connector 4 is smaller than that of the gas flow opening 11 in the vicinity of the second connector 6. In the dimensioning of the cross section of a gas flow opening corresponding with each connector, the volume and shape of a corresponding gas flow channel have been taken into account such that in a switching situation, the velocity of gas discharging out of each gas flow opening is substantially the same.

The frame structures of a mounting space for a switching device may be earthed. It is advantageous to position the gas flow openings 10 and 11 at the upper part 14 of the frame 2 so that discharging gases in a switching situation do not exit the frame 2 in between a live connector and the frame structures of the mounting space. The conductive gas being discharged between a live conductor and an earthed structure of the mounting space could cause a danger of an earth fault which, by positioning of the gas flow openings 10 and 11 as shown in FIG. 1, can thus be prevented.

The gases generated by a switching event may form a layer containing soot, metallic particles and other corresponding residual material onto surfaces external to the frame 2 which, as the number of switching events increase, grows thicker and starts to spread, thus impairing the insulation characteristics of the switching device. Therefore it is also advantageous to position the gas flow openings 10 and 11 as shown in FIG. 1. In addition to the gas flow openings 10 and 11 residing far away from the earthed parts, each connector contributes to preventing gases from flowing between a connector and an earthed part. This characteristic is enhanced by the connectors 4 and 6 being substantially wider than the gas flow openings 10 and 11.

The smaller the frame 2 and the higher the voltages used, the more important it is to position the gas flow openings such that no gas generated in a switching situation is allowed to flow in between a live connector and an earthed part. The same applies to sufficient cooling of gases before discharge.

The above-described structure enables the size of a switching device to be decreased and the switching device to be mounted closer to the earthed parts of the mounting space. The characteristics are advantageous as far as use of space is concerned.

In addition to taking a danger of an earth fault between a live connector and an earthed part into account in the design and positioning of gas flow openings, a danger of short circuit between phases is, of course, also to be taken into account. Gas discharging out of the frame of a switching device is not to be conducted in between live phase connectors such that the connectors would be short-circuited. As to the danger of short circuit between connectors, all live components coupled thereto, such as bolts used for connecting cables or busbars, are, of course, to be taken into account. A danger of direct short circuit between gas flows of different phases of a switching device is also to be taken into account in designing and positioning gas flow openings.

It is obvious to one skilled in the art that the basic idea of the invention can be implemented in many different ways. The invention and its embodiments are thus not restricted to the above-described examples but they may vary within the scope of the claims.

The invention claimed is:

1. A switching device configured to open and close a current circuit, the switching device comprising a frame, a first connector and a second connector, the first connector and the second connector extending from an interior of the frame to an exterior of the frame, means for connecting the first and the second connector electrically to one another, and a gas flow opening provided in the frame and arranged for a first part of a gas flow produced by a switching event, the first part of the gas flow being the part that is produced between the first connector and the means for connecting, wherein the first connector comprises a hole formed in a portion of the first connector located inside the frame and configured to conduct an electric current of the current circuit in a closed state of the switching device, the hole being provided for said first part of the gas flow and being located and dimensioned such that a substantial portion of the first part of the gas flow will flow through the hole.

2. The switching device as claimed in claim 1, wherein the frame includes an upper part and a lower part, the lower part being arranged to reside in the vicinity of frame structures of a mounting space, such as a switchgear cubicle, and wherein said gas flow opening provided in the frame resides farther from the lower part of the switching device than the first connector and the second connector do.

3. The switching device as claimed in claim 1 wherein the first connector and the second connector are identical with one another.

4. The switching device as claimed in claim 1, comprising one gas flow opening for each connector, wherein said gas flow openings differ in the size of their cross-sectional area.

5. The switching device as claimed in claim 4, wherein the surface area of each said gas flow opening is dimensioned such that in a switching situation, the velocity of gas discharging out of each gas flow opening is substantially the same.

6. The switching device as claimed in claim 2, wherein the first connector and the second connector are identical with one another.

7. The switching device as claimed in claim 2, comprising one gas flow opening for each connector, wherein said gas flow openings differ in the size of their cross-sectional area.

8. The switching device as claimed in claim 3, comprising one gas flow opening for each connector, wherein said gas flow openings differ in the size of their cross-sectional area.

9. A switching device configured to open and close a current circuit, the switching device comprising a frame, a first connector and a second connector, the first connector and the second connector extending from an interior of the frame to an exterior of the frame, means for connecting the first and the second connector electrically to one another, the switching device is configured to be connected to the current circuit by the first connector and the second connector such that the current circuit may selectively be opened and closed in a switching event by the means for connecting the first and the second connector, the frame having a gas flow opening adapted for a first part of a gas flow produced by the switching event to exit the switching device, the first part of the gas flow being the part that is produced between the first connector and the means for connecting, wherein the switching device has a gas flow channel adapted for the first part of the gas flow to travel towards the gas flow opening, the gas flow channel comprising a hole provided in a portion of the first connector located inside the frame and the first connector is adapted to conduct an electric current of the current circuit in a closed state of the switching device, the hole formed in the first connector being located and dimensioned such that substantial portion of the first part of the gas flow will flow through the hole.

10. The switching device as claimed in claim 1, wherein a part of the frame adjacent to the first connector is provided with a through-hole for a gas flow and is aligned with the hole in the first connector.

11. The switching device as claimed in claim 9, wherein a part of the frame adjacent to the first connector is provided with a through-hole for a gas flow and is aligned with the hole in the first connector.

12. A switching device configured to open and close a current circuit, the switching device comprising a frame, a first connector and a second connector, the first connector and the second connector extending from inside the frame to outside the frame, means for connecting the first and the second connector electrically to one another, the switching device is adapted to be connected to the current circuit by the first connector and the second connector such that the current circuit may selectively be opened and closed in a switching event by the means for connecting the first and the second connector, the frame having a gas flow opening adapted for a first part of a gas flow produced by the switching event to exit the switching device, the first part of the gas flow being the part that is produced between the first connector and the means for connecting, wherein the switching device has a gas flow channel adapted for the first part of the gas flow to travel towards the gas flow opening, the gas flow channel comprising a hole provided in a portion of the first connector located inside the frame and adapted to conduct an electric current of the current circuit in a closed state of the switching device, the hole formed in the first connector being located and dimensioned such that the gas flow channel passing through the hole is the route of least flow resistance between the place of formation of the first part of the gas flow and the glass flow opening.

* * * * *